United States Patent [19]

McPeak

[11] 4,219,121

[45] Aug. 26, 1980

[54] SAFETY SYSTEM FOR USE IN ASSOCIATION WITH MATERIAL HANDLING EQUIPMENT

[75] Inventor: Garold L. McPeak, Winona, Minn.

[73] Assignee: Burro-Badger Corporation, Winona, Minn.

[21] Appl. No.: 879,741

[22] Filed: Feb. 21, 1978

[51] Int. Cl.[2] ..... G08B 21/00

[52] U.S. Cl. ..... 212/153; 340/685

[58] Field of Search ..... 212/39 R, 39 DB, 39 A; 180/82 R; 340/685; 91/373, 377

[56] References Cited

U.S. PATENT DOCUMENTS

| | | | |
|---|---|---|---|
| Re. 22,525 | 8/1944 | White | 212/39 |
| 1,558,635 | 10/1925 | Rutan | 212/39 |
| 1,834,985 | 12/1931 | Stoner | 212/39 |
| 2,744,637 | 5/1956 | Stewart | 212/39 DB |
| 3,204,720 | 9/1965 | Eitel | 182/19 |
| 3,265,220 | 8/1966 | Knight | 212/39 R |
| 3,266,638 | 8/1966 | Popov | 212/39 R |
| 3,586,841 | 6/1971 | Griffin | 235/151.33 |
| 3,792,780 | 2/1974 | Spain | 212/39 R |
| 3,952,827 | 4/1976 | Drutchas | 180/82 R |
| 3,969,714 | 7/1976 | Greer | 212/39 R X |

FOREIGN PATENT DOCUMENTS 959943 3/1957 Fed. Rep. of Germany ..... 212/39 DB

OTHER PUBLICATIONS

Advertising Circular, "Hydraulic Cranes," Grove Manufacturing Co., pp. 81.00, 82.00.

*Primary Examiner*—Stephen G. Kunin
*Assistant Examiner*—Terrance L. Siemens
*Attorney, Agent, or Firm*—Charles F. Pigott, Jr.

[57] ABSTRACT

An improved apparatus is used on a crane to prevent engagement of a block with the outer end portion of a boom. When the block comes within a predetermined distance of the outer end portion of the boom, a detector assembly provides a danger signal. In response to this danger signal, an audio-visual alarm is activated and all control valves which are actuated to a position to cause the block to come in contact with the boom are moved toward to neutral positions. A linkage between a manually actuatable control lever and a control valve for a particular crane function includes a hydraulic cylinder. This cylinder is normally pressurized to a fully extended position, but when a danger signal is received indicating that the block is too close to the boom, the cylinder is retracted. This shortens the linkage and shifts the control valve to a neutral position.

17 Claims, 10 Drawing Figures

SAFETY SYSTEM FOR USE IN ASSOCIATION WITH MATERIAL HANDLING EQUIPMENT

BACKGROUND OF THE INVENTION

The present invention relates to an apparatus for preventing a block suspended by a boom cable from engaging a second block mounted on the outer end portion of the boom.

A crane is generally operated with a hook, grab, or similar device connected to a block suspended from by a boom cable. A winch is used to pay in or out the cable to raise or lower the hook etc. In addition, the crane may have a telescoping boom, and the boom may be pivotable from a position where it is nearly horizontal to one where it is nearly vertical. Any one of these operations can cause the block to come into engagement with the outer end portion of the boom from which it hangs. Such engagement can cause severe damage to the crane itself.

Prior art devices have attempted to keep the block a safe distance from the outer end portion of the boom. When there is contact between the tool and the end of the boom, it is called "two-blocking" because the block on the tool comes in contact with the block on the outer end portion of the boom. The present invention prevents this and is called an "anti-two-block" system.

There have been prior art "anti-two-block" systems for use with electric cranes. The patents issued to Rutan (U.S. Pat. No. 1,558,635) and Stoner (U.S. Pat. No. 1,834,985) show limit switches which disconnect electrical power to the hoist motor when "two-blocking" becomes imminent. The patent issued to White (U.S. Pat. No. Re. 22,525) discloses an electrical system which can compensate for the interaction between two crane functions (boom pivot and cable payout) and stop those functions when "two-blocking" is about to occur.

The prior art discloses systems which place control levers in a neutral position before the crane reaches an unsafe condition. One of these is disclosed in a patent to Spain (U.S. Pat. No. 3,792,780) in which the control levers are clamped in a neutral position by a fail-safe mechanism when the load on the crane exceeds a predetermined limit.

OBJECTS AND SUMMARY OF THE INVENTION

The present invention provides a new and improved "anti-two-block" system which automatically stops any crane function that could be causing a tool suspended by the crane cable to be drawn closer to the outer end portion of the boom than a predetermined limit. When the system detects a potential "two-block" situation, the controls are disabled from drawing in the cable, extending the boom, and/or pivoting the boom downward. The operator may, however, move the controls to a position to lower the cable, telescope the boom inward or pivot the boom upward. In addition, when the system detects a potential "two-block" situation, the operator is alerted by an audio and visual alarm.

The linkage connecting each control lever with the associated hydraulic control valve includes a safety cylinder which is operable between two positions to lengthen or shorten the linkage. Under normal operating conditions, pressure is supplied to the safety cylinder to maintain it in its extended position. The operator may then move the control valve to any of three positions to regulate the crane function. In the case of the boom telescope function, these positions correspond to a boom extend position, a boom retract position, and a neutral position at which boom length is kept constant. When the system receives a signal indicating that a "two-block" situation is imminent, the fluid supply to the safety cylinder is reversed, and the cylinder moves to its contracted position. This shortens the linkage and prevents the operator from selecting one of the three control valve positions. Typically, in the case of the boom telescope function, the operator is prohibited from selecting the boom extend position.

The short cable detection apparatus includes a spring-loaded limit switch which is located at the outer end portion of the boom. A metal tube through which the cable passes is suspended by a chain from the switch. When the cable block is drawn in close enough to the outer end portion of the boom to lift the weight of the tube off the chain, the spring closes the switch and effects actuation of the system.

Accordingly, it is an object of the present invention to provide a new and improved "anti-two-block" system which is capable of preventing contact between a block suspended from a crane boom and the end portion of the boom.

Another object of this invention is to provide a new and improved apparatus which is effective to detect when the distance which a cable extends outwardly from a boom is less than a predetermined distance and is thereupon effective to interrupt shortening of the cable.

Another object of this invention is to provide a new and improved apparatus which responds to an excessive decrease in the length of cable extending from a boom by actuating a portion of a control linkage to prevent any further decrease in the length of cable extending from the boom.

It is a further object of the present invention to provide an "anti-two-block" system as set forth in any of the preceding objects in which operator controls for crane functions which could be causing "two-blocking" are placed automatically moved away from positions which promote "two-blocking" when the tool hanging from the crane comes dangerously close the outer end portion of the boom.

BRIEF DESCRIPTION OF THE DRAWINGS

These and other objects and features of the present invention will become apparent from the following specification describing preferred embodiment shown in the accompanying drawings wherein.

Figure 1:
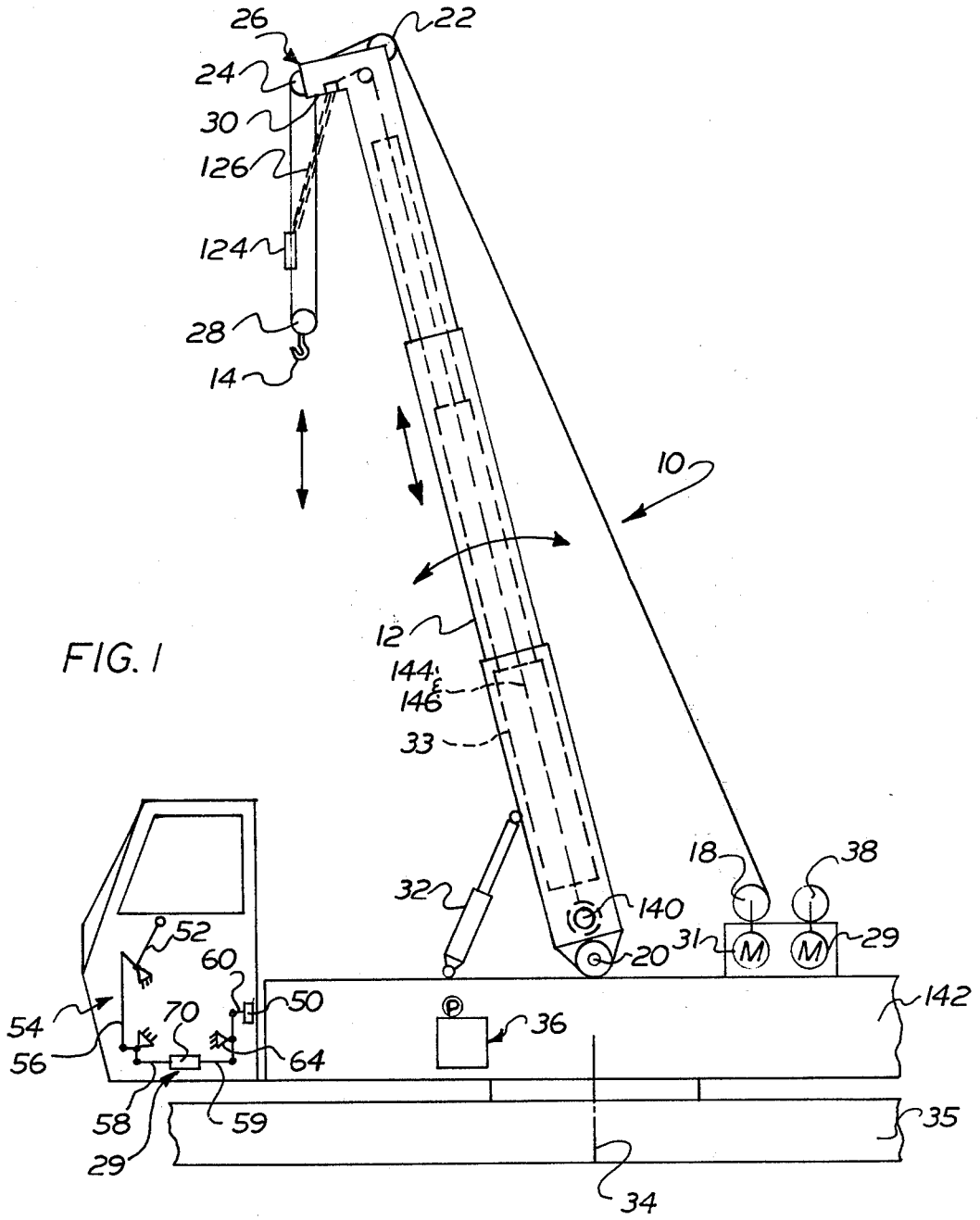
FIG. 1 is a side elevational view of a crane equipped with the "anti-two-block" system of the present invention.

A crane 10 includes a boom 12 from which a hook 14 is suspended by a cable 16 (FIG. 1). Although the present invention is shown and described as having a hook 14 connected to a block 28, it is to be understood that a grab, wrecking ball or other similar tool could be connected to the block. The cable 16 is extended or retracted by a main winch 18 located a small distance from the boom pivot 20. Alternately, the cable 16 may be connected to an auxiliary winch 38. The cable 16 extends from the winch 18 over blocks or sheeves 22 and 24 located on the outer end portion 26 of the boom 12 and around the block 28 associated with the hook 14 or other tool. The end 30 of the cable 16 is fixedly connected the outer end portion of the boom.

In operation, the main winch 18 is driven by a drive motor 29 to raise or lower the hook 14 or other tool. If desired, an auxiliary winch drive motor 31 can be energized to drive the auxiliary winch 38. The motor cylinder 32 may be extended or retracted to cause the boom 12 to pivot around the connection 20. Because of the distance between the winch 18 and the pivot 20, when the cylinder 32 is retracted and the boom 12 pivoted downward, the hook 14 and block 28 are drawn closer to the outer end portion 26 of the boom 12. Further, a crane boom motor 33 may be activated to telescopically extend or retract the boom. This too can cause the hook 14 and block 28 to be drawn toward the block 24. It is to be noted that the crane may also be pivoted relative to a truck body 35 about an axis 34, but that mode of operation is not relevant here since it does not change the distance between the block 24 and the block 28.

When the block 28 is drawn toward the block 24 mounted on the boom 12 care must be taken to avoid contact between the blocks 24 and 28. If the block 28 is drawn forcibly into the block 24 damage to the crane could result. The cable 16 may break under the increased load and/or the outer end portion 20 of the boom 12 may be damaged. When the block 28 is drawn into engagement with block 24 by whatever mode of crane operation, it is called "two-blocking", and throughout this specification the term is used with this meaning. The present invention provides a system 29 that prevents "two-blocking".

Figure 2:
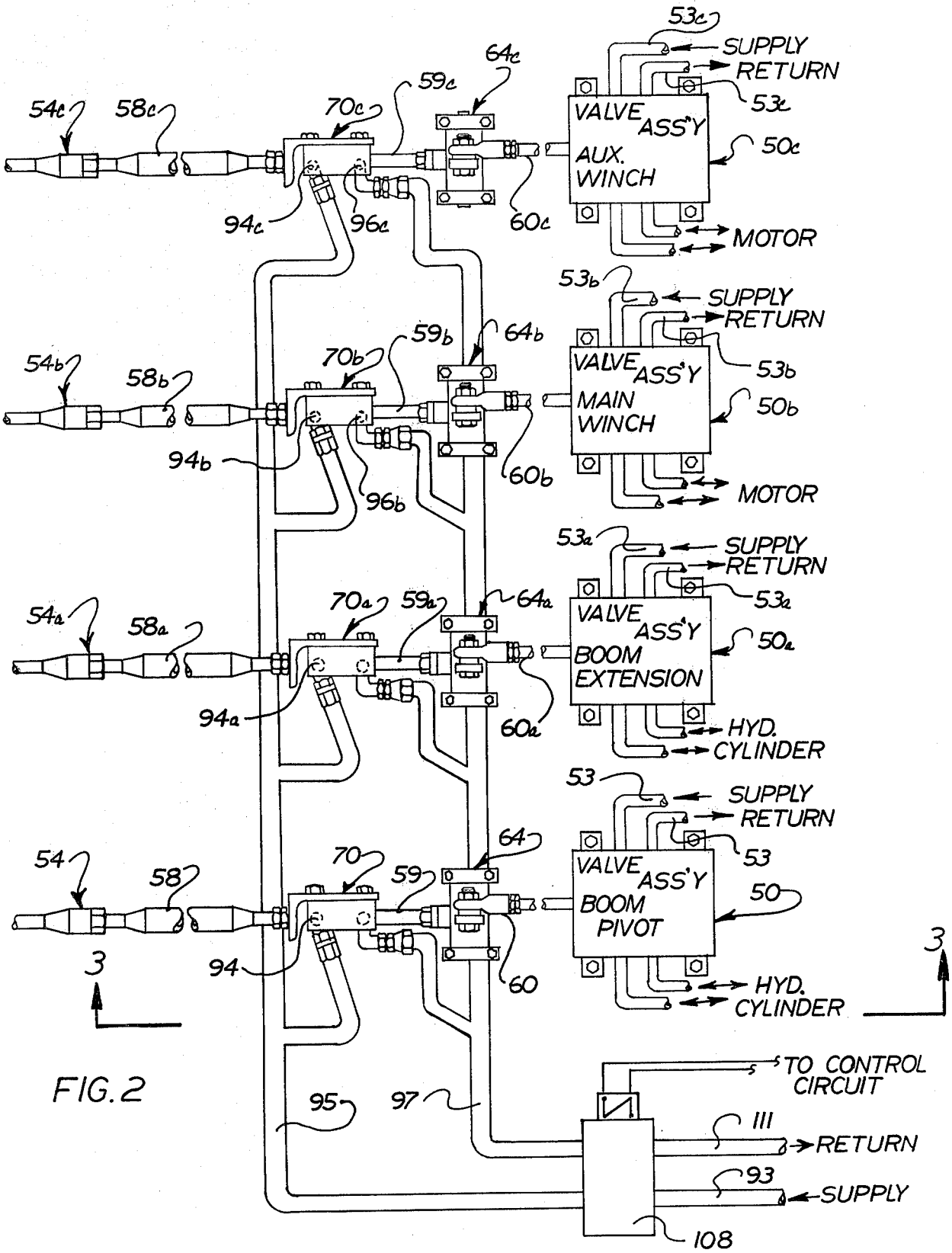
FIG. 2 is a plan view on an enlarged scale, of a portion of the "anti-two-block" system of FIG. 1 showing linkages, cylinders, and control valves associated with four crane motors.
Figure 3:
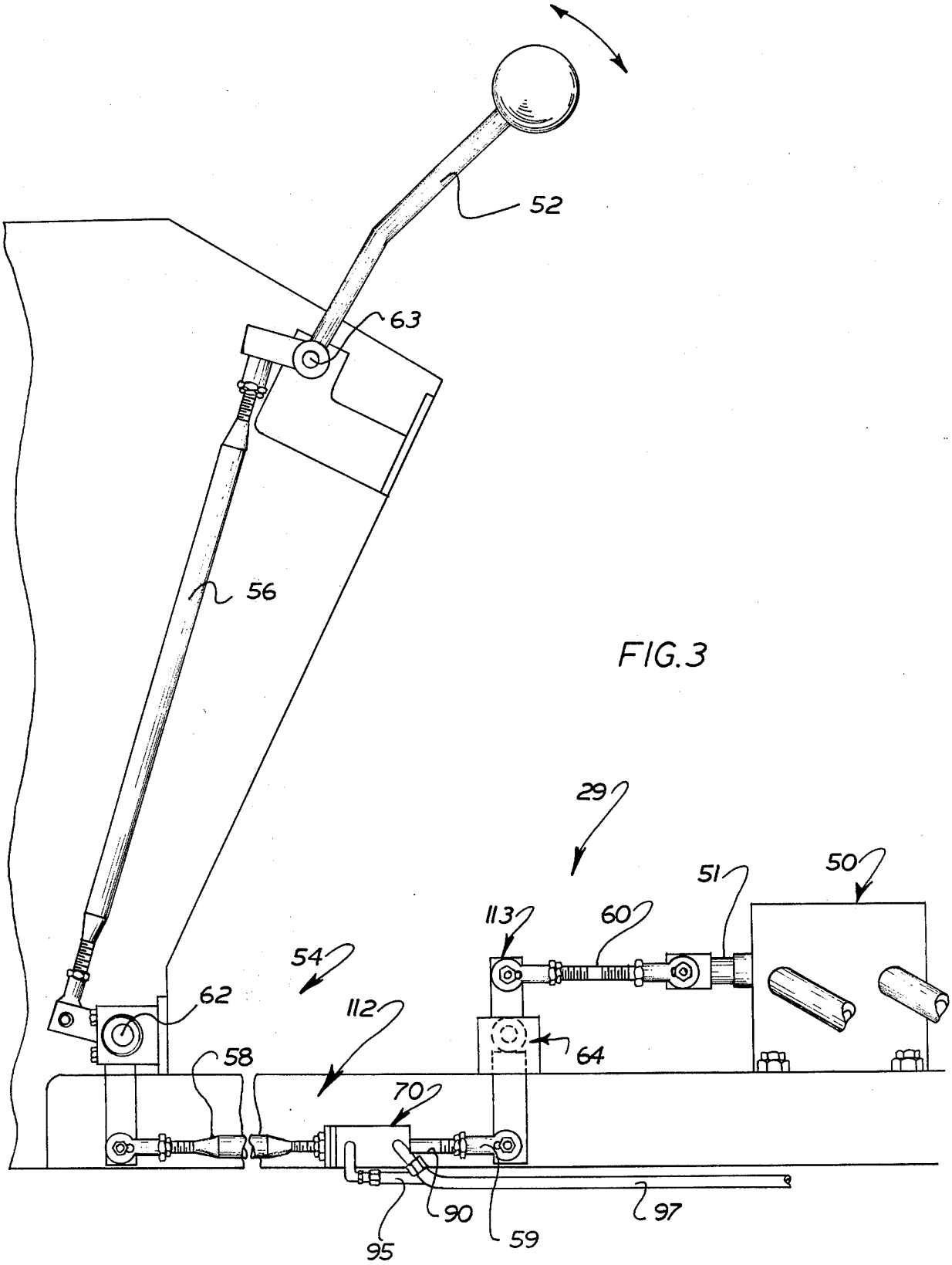
FIG. 3 is a side elevational view taken generally along line 3—3 in FIG. 2 and also including a control lever and associated linkages.

A hydraulic supply indicated generally at 36 supplies hydraulic fluid under pressure to each of the operating motors of the crane, that is, to the main and auxiliary winch motors 29 and 31, boom pivot cylinder 32, and boom extension motor 33. Each of these motors is controlled by a separate manually actuatable control valve 50, 50*a*, 50*b*, and 50*c* (FIGS. 1, 2 and 3). It should be understood that the boom extension control valve 50*a* which controls the motor 33, main winch control valve 50*b* which controls the winch motor 29, and the auxiliary winch control valve 50*c* which controls the winch motor 31 are of the same construction as the pivot motor control valve 50 which controls the operation of the boom pivot motor 32. It is further understood that by "manually actuatable" is meant a device actuatable by means of foot pedals, hand levers or the like.

The pivot motor control valve 50 is connected to an associated hand lever 52 by a linkage 54. The linkage 54 includes various links 56, 58, 59 and 60 which are movable about pivots 62, 63 and 64 to transmit motion from the lever 52 to the control valve 50. A control linkage 54*a* (FIG. 2) connects the boom extension control valve 50*a* with a suitable manually actuatable control member, such as a hand lever or foot pedal (not shown). Another control linkage 54*b* connects the main winch control valve 50*b* with a manually actuatable control member (not shown). Finally, a control linkage 54*c* connects the auxiliary winch control valve 50*c* with a suitable control member (not shown).

It should be understood that although only the linkage 54 has been fully illustrated in FIGS. 1, 2 and 3, the linkages 54*a*, 54*b* and 54*c* have substantially the same construction as the linkage 54. Thus, the linkages 54*a*, 54*b* and 54*c* (FIG. 2) include links 58*a–c* and 60*a–c* which correspond to the links 58 and 60 of the linkage 54 (FIG. 3) and pivot connections 64*a–c* (FIG. 2) which correspond to the pivot connection 64 (FIG. 3).

The control valve 50 is a three position valve. The hydraulic circuitry is connected with the valve 50 so that the motor 32 has forward, hold or neutral, and reverse modes of operation corresponding to positions of the valve 50. Thus in the case of the boom pivot cylinder 32, the control valve 50 may be moved to a first actuated position where the boom moves toward a vertical position as the pivot motor 32 extends, or to a second or neutral position where the angle between the boom 12 and the movable crane base 142 remains constant, or to a third actuated position where the hydraulic pivot cylinder supporting the boom is contracted and the boom moves toward a horizontal position. The control lever 52 is movable between three positions corresponding to the three positions of the control valve 50.

It will be observed that between links 58 and 59 is safety cylinder 70 (FIGS. 4 and 5) mounted on a movable angle bracket 78. This hydraulic cylinder 70 is provided in the linkage 54 to shorten the linkage in response to a signal indicating that a "two-blocking" situation is imminent. Although only the hydraulic cylinder 70 has been shown in FIGS. 4 and 5, similar cylinders 70*a*, 70*b* and 70*c* (FIG. 2) are provided in the linkages 54*a*, 54*b* and 54*c*.

Figure 4:
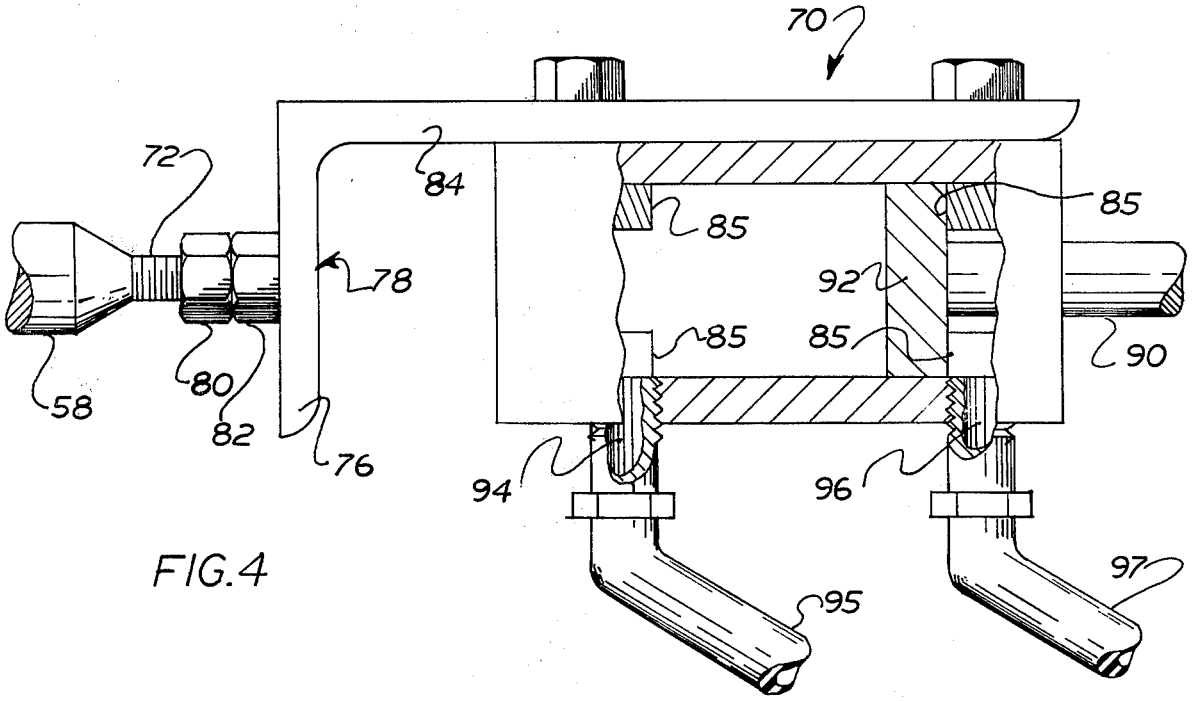
FIG. 4 is an enlarged fragmentary sectional view showing a safety cylinder included in the linkage of FIG. 2 in an extended position.
Figure 7:
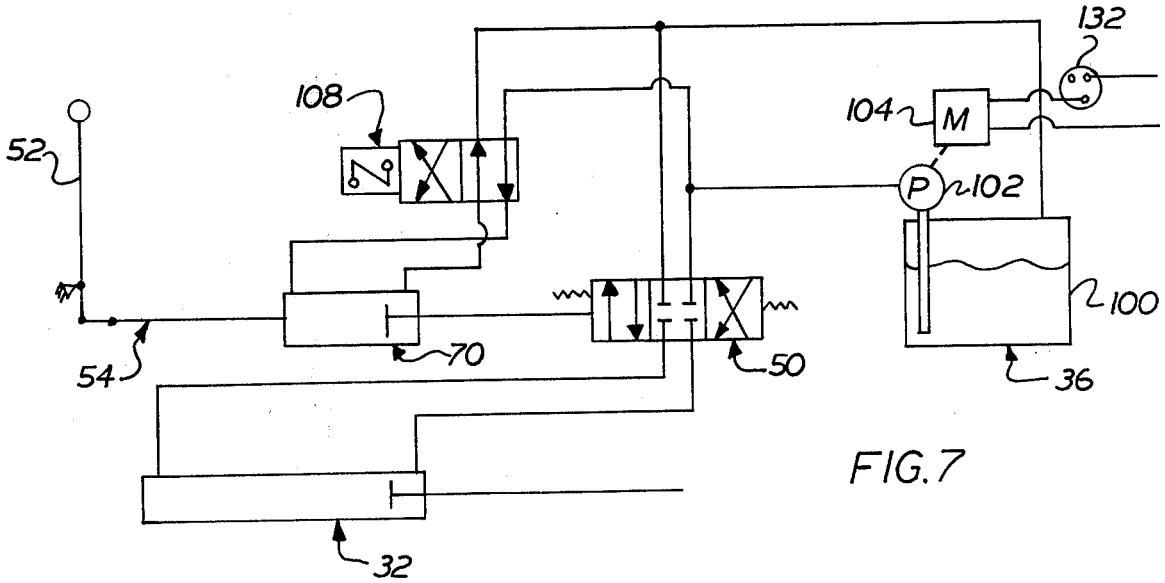
FIG. 7 is a schematic diagram of a hydraulic circuit which is included in the "anti-two-block" system of FIG. 1 and showing the safety cylinder in its extended position, and a control lever and valve in their neutral positions.
Figure 8:
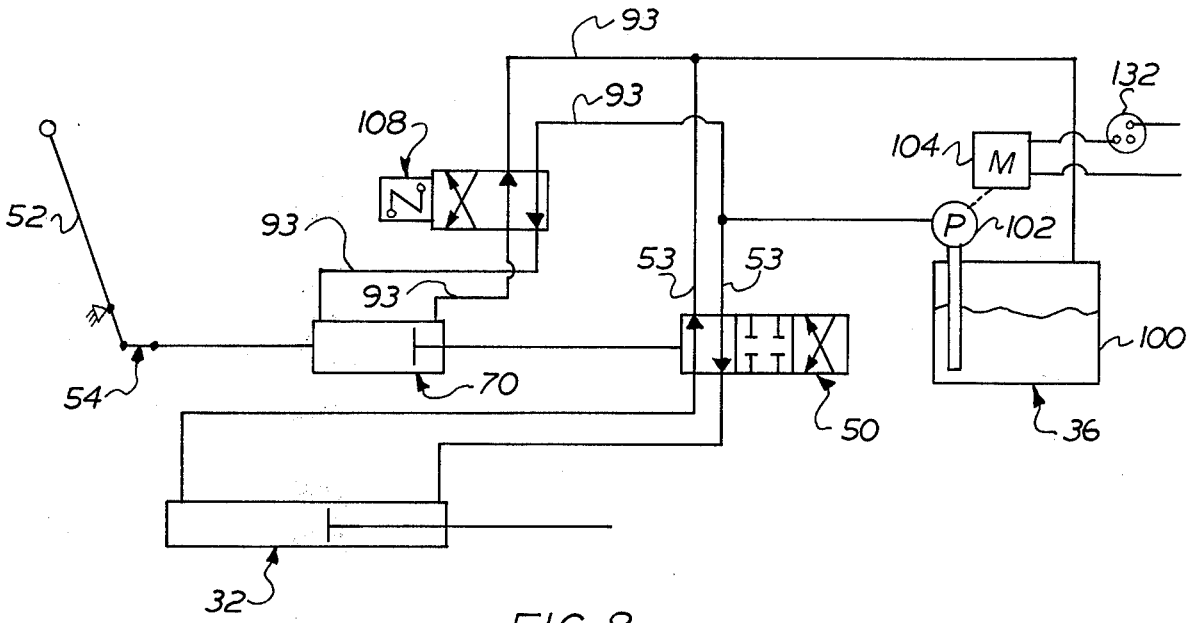
FIG. 8 is a view similar to FIG. 7 but showing the control valve moved to cause a boom pivot cylinder to retract.

When the cylinder 70 is in the extended or normal condition of FIGS. 4, 7 and 8, the linkage 54 has a maximum length. When the cylinder 70 is contracted in response to the occurrence of an impending "two-blocking" condition, the linkage 54 has a minimum length. The difference between the two lengths of the linkage 54 is exactly the amount required to move the valve 50 from the third actuated position to the second or neutral position.

Figure 5:
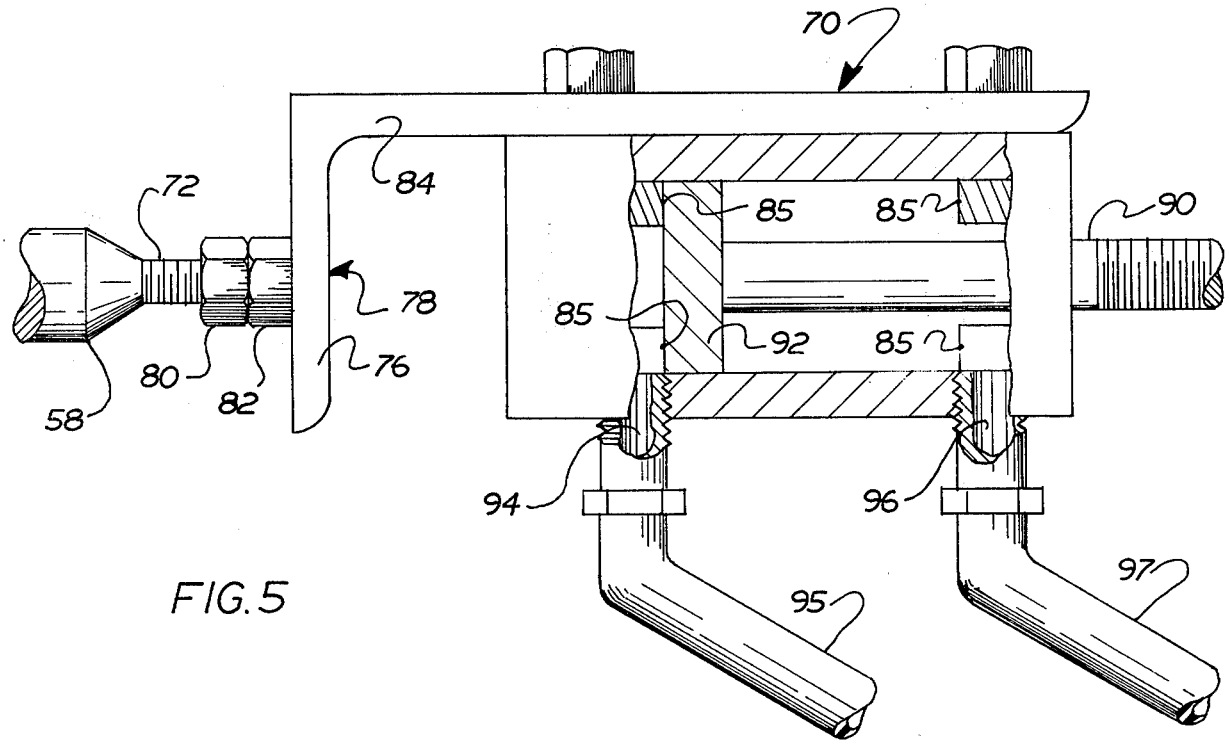
FIG. 5 is a view similar to FIG. 4 but showing the safety cylinder in its contracted position.

The safety cylinder 70 is mounted between links 58 and 59 (FIG. 3) on the movable angle bracket 78. The threaded end portion 72 (FIG. 4) of link 58 is engaged by a suitably threaded passage in one leg 76 of an angle bracket 78. Lock nuts 80 and 82 assure that the link 58 does not vibrate loose. The second leg 84 of angle bracket 78 is disposed at a right angle to the first leg 76 with the link 58 coaxial with the link 59 and with safety cylinder 70. The hydraulic safety cylinder 70 is of a known construction and includes suitable stop surfaces 85 to limit the motion of the circular piston 92. Although the mounting arrangement of only the cylinder 70 on the bracket 78 is shown in FIGS. 4 and 5, similar mounting arrangements are used in association with the cylinders 70*a*, 70*b* and 70*c* (see FIG. 2). Hydraulic fluid is supplied to the safety cylinders 70, 70*a*, 70*b*, and 70*c* through flexible conduits 95 and 97.

The "anti-two-block" system 29 of the present invention will shorten each of the four linkages 54, 54*a*, 54*b* and 54*c* when the system receives a signal from a detector assembly 71 (FIGS. 1 and 6) indicating that "two-blocking" is imminent (FIG. 2). Shortening the linkages 54, 54*a*, 54*b* and 54*c* makes sure that the control valves 50, 50*a*, 50*b*, and 50*c* are not in danger producing modes: that is, boom extend, pivot boom downward, and auxiliary or main winch cable pull in modes. During normal operation hydraulic fluid under pressure is supplied to port 94 of cylinder 70 through a flexible conduit 95 and port 96 is connected to the flexible fluid return conduit 97 (FIG. 4). Thus during normal operation the cylinder 70 is in the extended position with the piston 92 to the right as shown in FIG. 4.

When the "anti-two-block" system 29 is activated, a control valve 108 (FIG. 8) is actuated (FIG. 9) to direct high pressure fluid to the rod end of the cylinder 70 through the conduit 97 and to connect the head end of the cylinder with drain through the conduit 95. This causes piston 92 to move to the left (FIG. 5) and the linkage 54 to contract. If control valve 50 had been in a dangerous "two-block" causing mode, it is returned to its neutral position.

Each of the control valve assemblies 50, 50*a*, 50*b*, and 50*c* is connected so that each potentially dangerous operating mode (boom extend, boom pivot down, main winch cable retract, or auxiliary winch cable retract) is selected by applying compressive forces to the safety cylinders 70, 70*a*, 70*b* and 70*c*. Under normal operating conditions the pressurized hydraulic fluid in the cylinders 70, 70*a*, 70*b* and 70*c* transmit this compressive force and the control valves 50, 50*a*, 50*b* and 50*c* may be moved into one of the potentially dangerous operating modes. However, when the "anti-two-block" system 29 is activated, all of the safety cylinders 70, 70*a*, 70*b* and 70*c* are contracted. This effects a simultaneous shortening of the linkages 54, 54*a*, 54*b* and 54*c*. The shortening of the linkages moves to neutral any control valves 50, 50*a*, 50*b* or 50*c* which may be in an actuated condition corresponding to one of the potentially dangerous operating modes. This stops the operation of the crane 10 which would otherwise create a dangerous "two-block" situation.

It should be noted that shortening each of the linkages 54, 54*a*, 54*b* and 54*c* by simultaneously contracting the safety cylinders 70, 70*a*, 70*b* and 70*c* moves each of the control valves 50, 50*a*, 50*b* and 50*c* through a distance equal to the distance which the valve is shifted in moving from neutral to a fully actuated position. Therefore, if a control valve is in a partially actuated position corresponding to a potentially dangerous operating mode (i.e., a mode which promotes "two blocking") it is moved through neutral to a partially actuated position corresponding to a danger reducing mode. Thus, if the valve 50 has been moved only part way toward the fully actuated condition of FIG. 8, the valve is moved leftwardly through the neutral position of FIG. 9 to a partially actuated position in which high pressure fluid is ported to the head end of the motor cylinder 32 to effect a raising of the boom 12.

Figure 9:
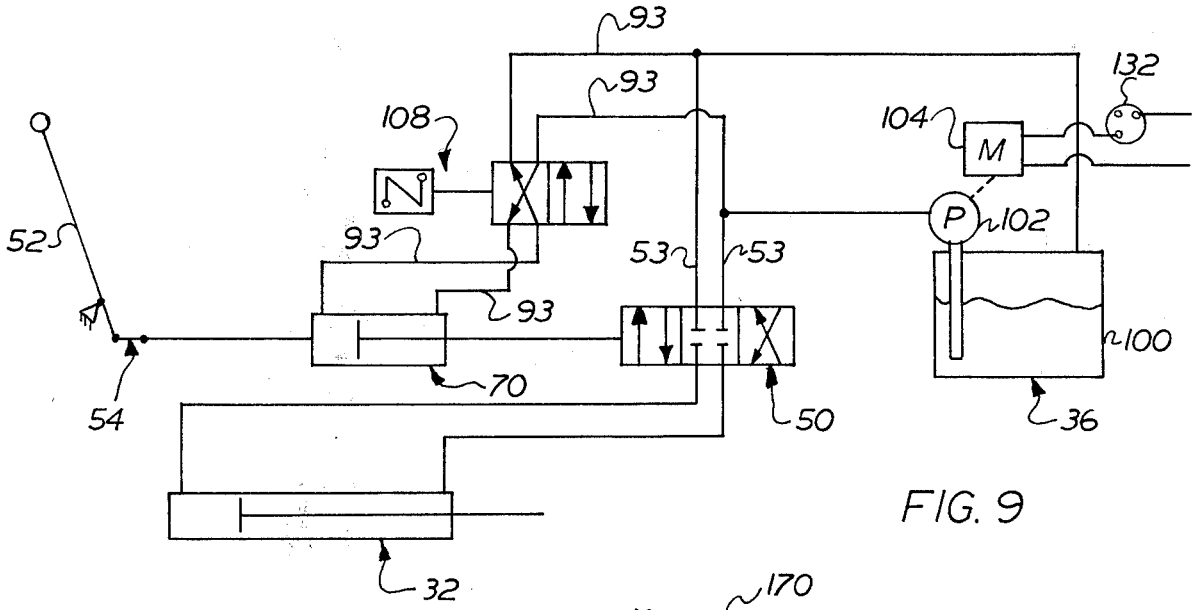
FIG. 9 is a view similar to FIG. 7 but showing the control valve moved to a neutral position by the safety cylinder.

A portion of the hydraulic system used in the "anti-two-block" system of the present invention is shown schematically in FIGS. 7, 8, and 9 along with a schematic linkage 54 and control lever 52. It will be understood that FIGS. 7–9 illustrate one portion of the hydraulic system and that there are three more control valves 50*a*, 50*b* and 50*c*, safety cylinders 70*a*, 70*b* and 70*c*, and control members corresponding to the control lever 52. Actuation of the valves 50*a*, 50*b* and 50*c* effects operation of the corresponding crane motors 33, 29 and 31.

A pump 102 is driven by a motor 104 which is activated by the ignition switch 132 to draw hydraulic fluid from a reservoir 100. Hydraulic fluid under pressure is supplied through a flexible conduit 53 to the control valve 50 which is spring biased to its center or neutral position. Hydraulic fluid under pressure is also supplied through conduit 93 to solenoid valve 108. In the absence of an impending "two-blocking" condition, fluid pressure is ported through the valve 108 to the head end of the safety cylinder 70 to keep the cylinder and the linkage 54 in the extended condition shown in FIG. 7. When it is desired to pivot the boom downward, the control lever 52 is pulled to the left (FIG. 8). This motion is transmitted through linkage 54 and cylinder 70 to the control valve 50 which moves to the actuated position shown in FIG. 8. Actuation of the control valve 50 ports high pressure hydraulic fluid through a flexible conduit 55 to the cylinder 32. A return line 110 conducts hydraulic fluid back to the control valve 50 and drain conduit 111.

Conceptually, the linkage 54 may be broken into two sections 112 and 113 (FIG. 3). A first section 112 includes the manually actuatable member 52, links 58 and 56, pivots 62 and 63 and safety cylinder 70. The second section 113 comprises the piston rod 90, links 59 and 60 the pivot 64 and the control valve 50. When the lever 52 is moved to the left (as viewed in FIG. 3) a compressive force is applied to the safety cylinder 70 (see FIG. 8). The cylinder 70 does not collapse because fluid pressure is supplied to the head end of the cylinder through flexible conduit 95. This enables the control valve 50 to be moved to a position to lower the boom 12 by contracting cylinder 32. If during operation in this mode the block 28 comes within a predetermined distance of the outer end portion 26 of the boom 12, the detector assembly 71 (FIG. 6) provides an output signal to energize the solenoid valve 108. Actuation of the solenoid valve 108 effects actuation of the valve 50 back to neutral to prevent the occurrence of a "two-blocking" condition (see FIG. 9).

Actuation of the valve 108 (FIG. 9) ports hydraulic pressure to conduit 97 to retract the cylinder 70. This shortens the second section 113 (FIG. 3) of the linkage 54 and returns control valve 50 to a neutral position. The control valve 50 is returned to a neutral position (FIG. 9) even though the control lever 52 remains pushed to the left because the second section 113 of the linkage 54 is not long enough to select the valve position which caused the "two-block" situation. This is because the piston 92 has moved to the retracted position of FIGS. 5 and 9.

The control valve 50 may be in a position to select a danger producing mode of crane operation, i.e., it is causing the boom to pivot downward. At the same time, a second control valve 50*a*, or 50*b*, or 50*c* may be in an opposite position, i.e., it is causing the boom 12 to telescope inward or the winch 18 or 38 to pay cable out. Upon activation of the solenoid 108 under these circumstances, the second control valve 50*a*, 50*b*, or 50*c* will not be returned to a neutral position. This can be understood by examining the various positions of the control linkage 54. The control lever like the control lever 52 in FIG. 3 must be pulled to the right in order to cause the boom 12 to telescope inward or the cable 16 to pay out. Thus the safety cylinder 70*a*, 70*b*, or 70*c* is under tension (rather than compression) when the associated control valve 50*a*, 50*b*, or 50*c* respectively is in a position to select a danger reducing mode of crane operation. Further, the spool of the control valve 50*a*, 50*b*, or 50*c* has been moved to the right (of FIGS. 2 and 3) in order to select the danger reducing modes of crane operation. When the system is activated and the linkage 54 is contracted by the reversal of the supply and return lines to safety cylinders 70, 70*a*, 70*b*, and 70*c*, the safety cylinder applies a force to the control valve spool tending to move it farther to the right. But the control valve spool cannot move anymore to the right, and consequently the shortening of linkage 54 causes the control lever 52 to move to the left to the neutral position.

By actual experience it has been found that the operator feels the change in the effective length of the control linkages 54, 54*a*, 54*b* and 54*c* as a gentle but forceful movement of the control levers 52 back to the neutral position. It has been further found that there is sufficient natural damping within the "anti-two-block" system 29 to prevent hunting. That is, the response time of the system 29 is sufficiently fast to prevent the block 28 from hitting the block 24, but is slow enough that should the operator immediately reverse the position of the control lever, no dangerous hunting occurs. The system operates by shortening the second section 113 of linkage 54 and returning the control valve 50 to the neutral position, thus preventing a "two-block".

Figure 6:
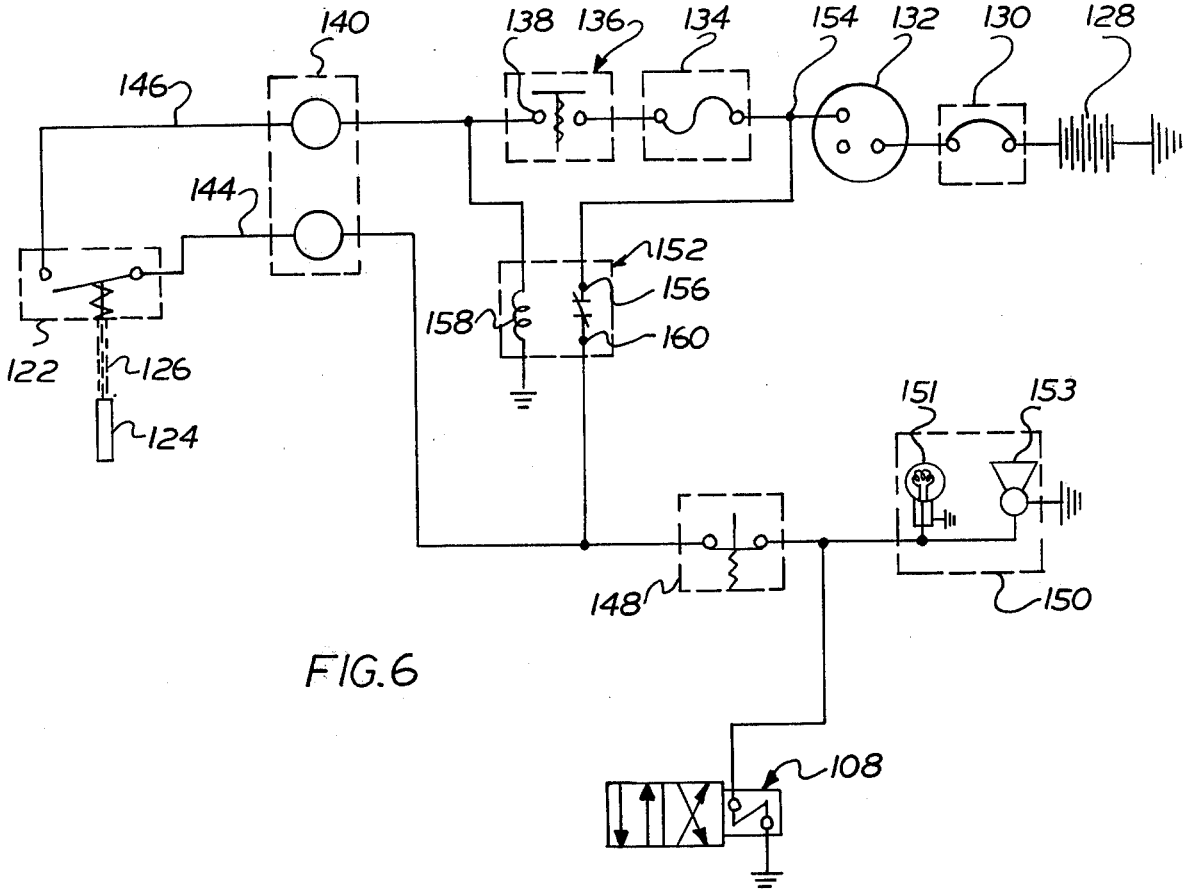
FIG. 6 is a schematic diagram of an electrical circuit which is included in the "anti-two-block" system of FIG. 1.
Figure 10:
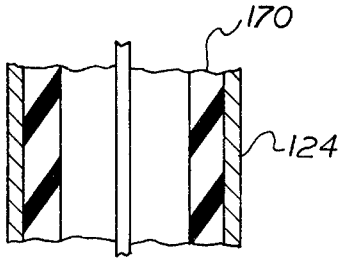
FIG. 10 is a fragmentary, longitudinal sectional view taken of a portion of the metal tube referred to above and utilized as part of the short cable detection apparatus, as shown in FIG. 1.

The purpose of the detector assembly 71 is to effect actuation of the solenoid valve 108 when a "two-blocking" situation is imminent (FIG. 6). A normally closed limit switch 122 located on the outer end portion 26 of the boom 12 is held open by the weight of a cylindrical metal tube 124. The tube 124 is suspended from switch 122 by a chain 126. The crane cable 16 passes through the tube 124 (FIG. 10). The cable is protected from abrasion against the tube 124 by a plastic or other friction reducing lining 170 in the tube (FIG. 10). When a "two-block" situation is imminent, the block 28 (FIG. 1) suspended by cable 16 lifts the tube 124 and allows the switch 122 (FIG. 6) to close.

Electrical current is supplied to the detector assembly 71 by a battery 128 to other source of electric power (FIG. 6). Power is fed through a circuit breaker 130 which protects the battery 128 against excessive current draw. From the circuit breaker 130 the current goes through an on-off ignition switch 132 and a fuse 134 to a normally open oil pressure switch 136. This switch 136 remains open until full oil pressure is obtained in the hydraulic system.

When normal oil pressure is obtained, electrical current is conducted from the oil pressure switch 136 to an electrical cable reel 140 which enables the circuit 120 to accommodate the telescopic action of the boom 12 (see FIG. 1). From reel 140, electrical current is conducted through an electrical conduit 38 in cable 144 to the limit switch 122, and if the limit switch is closed, indicating an imminent "two-block" situation, current is conducted back down cable 144 through a conductor 146 to the cable reel.

Current is fed from the cable reel 140 through a normally closed override switch 148 to the solenoid valve 108. When the solenoid 108 is thus activated, it directs fluid pressure to the opposite end of the safety cylinder 70. This operates the safety cylinders 70, 70*a*, 70*b*, and 70*c* to shorten the linkages 54, 54*a*, 54*b*, and 54*c* to stop the potential "two-block" in the manner previously discussed. Simultaneously an audio visual alarm 150 in the operator's cab 152 is set off. The alarm 150 includes a lamp 151 and a buzzer 153. Should it be necessary to override the "anti-two-block" system of the present invention, the operator may depress the override switch 148 which then interrupts the flow of current to the solenoid 108.

A normally closed relay 152 provides circuit check and fail-safe characteristics. When the ignition switch 132 is first turned on, power flows from terminal 154 to the relay 152. Because the coil 158 of the relay 152 is energized only when normal operating oil pressure closes switch 136, power flows through the now closed relay contacts 156 to the override switch 148. This causes power to flow to the solenoid 108 and the alarm 150. Once normal oil pressure is obtained, the relay coil 158 is energized by current flowing from terminal 138 on the oil pressure switch 136. This causes the relay to open the contacts, thus cutting power to the solenoid 108 and allowing normal operation of the control valves 50, 50*a*, 50*b* and 50*c* through the linkages 54, 54*a*, 54*b* and 54*c*. Should oil pressure be lost for any reason, alarm 150 is actuated and the system 29 is actuated to automatically prevent "two-blocking".

Thus is it clear that the present invention provides a new and improved "anti-two-block" system which automatically stops any crane function which could cause the tool 14 suspended by the crane cable 16 to be drawn closer to the outer end portion 26 of the boom 12 than a predetermined limit (FIG. 1). When the system detects a potential "two-block" situation, the control levers 52 are disabled from drawing in the cable 16, telescoping or extending outward the boom 12 or lowering the boom. The operator may, however, pay out the cable 16 from winches 16 or 38, telescope the boom 12 inward or raise the boom, each of which causes the block 28 to move away from the outer end portion 26 of the boom. In addition, when the system detects a potential "two-block" situation, the operator is alerted by an audio alarm 153 and visual alarm 151 on the operating panel.

The linkage 54 connecting each control lever 52 with the associated hydraulic control valve 50 includes a safety cylinder 70 which is operable to between two positions to lengthen or shorten the linkage. Under normal operating conditions, pressure is supplied to the cylinder 70 to maintain it in its extended position. The operator may then move the control valve 50 to any of three positions to regulate the crane function. In the case of the boom length function, those positions correspond to boom extend, boom retract, and keeping the boom length constant. When the system receives a signal indicating that a "two-blocking" situation is imminent, the hydraulic fluid supply to the cylinder 70 is reversed, and the cylinder moves to its contracted position. This shortens the linkage 54 and prevents the operator from selecting the one of the three control valve positions which corresponds to a potential for "two-blocking". Typically, in the case of the boom length function, the operator is prohibited from selecting the boom extend function.

The signal which activates the system is generated by a spring loaded limit switch 122 located at the outer end portion 26 of the boom 12. A metal tube 124 through which the cable 16 passes is suspended by a chain 126 from the switch 122. When the hook 14 or other tool is drawn close enough to the outer end portion 26 of the boom 12 to lift the weight of the tube 124 off the chain 126, the switch 122 closes and activates the system.

The following is claimed:

1. In a crane having a boom with an outer end portion from which a block is suspended, an apparatus for preventing engagement of the block with the outer end portion of the boom, said apparatus comprising drive means for moving the block relative to the outer end portion of the boom, control means for controlling said drive means, said control means being operable between a first condition in which said drive means effects movement of the block toward the outer end portion of the boom, a second condition in which said drive means effects movement of the block away from the outer end portion of the boom, and a third condition in which said drive means maintains a distance between the outer end portion of the boom and the block constant, detector means for providing a signal when the block is within a predetermined distance of the outer end portion of the boom, and means for effecting operation of said control means from said first condition to another one of said conditions in response to said signal for said detector means to thereby interrupt movement of the block toward the outer end portion of the boom, said control means including actuator means for effecting said operation of the control means, said actuator means including a manually actuatable member, linkage means for connecting said manually actuatable member with said control means, and means for changing the effective length of said linkage means in response to said signal from said detector means.

2. An apparatus as set forth in claim 1 further including alarm means for providing audio visual indicators in response to said signal.

3. In a crane having a boom with an outer end portion from which a block is suspended, an apparatus for preventing engagement of the block with the outer end portion of the boom, said apparatus comprising drive means for moving the block relative to the outer end portion of the boom, cable means for suspending said block from the outer end portion of the boom, control means for controlling said drive means, said control means being operable between a first condition in which said drive means effects movement of the block toward the outer end portion of the boom, a second condition in which said drive means effects movement of the block away from the outer end portion of the boom, and a third condition in which said drive means maintains the distance between the outer end portion of the boom and the block constant, detector means for providing a signal when the block is within a predetermined distance of the outer end portion of the boom, said detector means including a tube through which said cable passes, said tube being suspended from switch means controlling the detector means, said switch being held by the suspended tube in a position to maintain the detector means in a nonsignalling mode, said tube being positioned to engage and be raised against the influence of gravity when the block is within a predetermined distance from the outer end portion of said boom, to allow said switch means to change position to activate said detector means, and means for effecting operation of said control means from said first condition to another one of said conditions in response to said activated detector means, to thereby interrupt movement of the block toward the outer end portion of the boom.

4. The apparatus as set forth in claim 3 which includes a manually operated control member, and linkage means for connecting said manually operated control member with said drive means for moving the block relative to the outer end portion of the boom and correspondingly varying the length of cable which hangs from said boom, and further including means for varying the length of said linkage means in response to a decrease in the length of cable hanging from the outer end portion of the boom from a length greater than a predetermined length to a length less than a predetermined length.

5. An apparatus as set forth in claim 3 wherein said tube includes means for preventing abrasion between said tube and said cable, said means includes a friction reducing insert in said tube.

6. An apparatus for use in a crane having a boom from the outer end portion of which a cable hangs said apparatus including motor means for varying the length of the cable hanging downward from the outer end portion of the boom, motor control means for controlling said motor means, a manually operable control member, linkage means for connecting said manually operable control member and said motor control means, means for varying the length of said linkage means in response to a decrease in the length of cable hanging from the outer end portion of the boom from a length greater than a predetermined length to a length less than a predetermined length.

7. An apparatus as set forth in claim 6 wherein said control means is operable from a first position corresonding to a decrease in the length of cable hanging from the outer end portion of the boom, a second position in which said motor means holds the length of cable hanging from the boom constant, and a third position corresponding to an increase in the length of cable hanging from the outer end portion of the boom, said means for varying the length of the linkage having a first length when the length of cable hanging from the outer end portion of the boom exceeds a predetermined amount to thereby enable said manually operable control member to select either said first, second or third positions of said control means when the length of cable hanging from the outer end portion of the boom exceeds the predetermined length, and said means for varying the length of said linkage having a second length when the length of the boom is less than the predetermined amount to thereby enable said manually operable control member to select only said second or third positions of said control means.

8. An apparatus as set forth in claim 7 further including detector means for sending a signal in response to a decrease in the length of cable hanging from the outer end portion of the boom from a length greater than a predetermined length to a length less than a predetermined length, said detector means including a tube through which the cable passes, said tube being raised against the influence of gravity when the length of cable hanging from the outer end portion of the boom is less than the predetermined length.

9. An apparatus as set forth in claim 8 wherein said tube includes means for preventing abrasion between said tube and said cable, said means including a friction reducing insert in said tube.

10. An apparatus comprising a boom having an outer end portion, a cable extending from the outer end portion of said boom, motor means operable to vary the distance which said cable extends from the outer end portion of said boom, control means operable from a first condition to a second condition to effect operation of said motor means to decrease the distance which said cable extends from the outer end portion of said boom, linkage means for effecting operation of said control means between said first and second conditions, said linkage means having a first portion connected with said control means and a second portion which is moved by an operator to effect movement of said first portion of said linkage means and operation of said control means between said first and second conditions, detector means for detecting when the distance which the cable extends outwardly from said boom is less than a predetermined distance, and actuator means for effecting operation of said control means from the second condition to the first condition in response to detection by said detector means that the cable extends outwardly from the outer end portion of said boom for a distance which is less than the predetermined distance, said actuator means including means for effecting movement of said first portion of said linkage means relative to said second portion of said linkage means to effect operation of said control means from the second condition to the first condition.

11. An apparatus as set forth in claim 10 wherein said linkage means includes a piston and cylinder assembly interconnecting said first and second portions of said linkage means, said actuator means including a valve assembly and means for operating said valve assembly to port fluid under pressure to said piston and cylinder assembly in response to detection by said detector means that the cable extends outwardly from the outer end portion of said boom for a distance which is less than the predetermined distance.

12. An assembly as set forth in claim 10 wherein said control means includes a movable valve member which is in a first position blocking fluid flow to said motor means when said control means is in the first condition and is in a second position porting fluid pressure to said motor means when said control means is in the second condition, said valve member being connected with and movable by said first portion of said linkage means, said actuator means being operable to effect movement of said first portion of said linkage means relative to said second portion of said linkage means to move said valve member from said second position to said first position without moving the second portion of said linkage means.

13. An apparatus comprising an extensible and pivotable boom, a cable suspended from said boom, extension motor means for causing said boom to extend and retract, pivot motor means for causing said boom to pivot, cable motor means for causing the length of said cable hanging from said boom to increase or decrease, extension motor control means for controlling said extension motor means, said extension motor control means including an extension motor control valve, a manually operable extension control member, extension control linkage means for connecting said manually operable extension control member with said extension motor control valve, and first means for varying the length of said extension linkage control means, pivot motor control means for controlling said pivot motor means, said pivot motor control means including a pivot motor control valve, a manually operable pivot control member, pivot control linkage means for connecting said pivot control member with said pivot motor control valve, and second means for varying the length of said pivot control linkage means, cable motor control means for controlling said cable motor means, said cable motor control means including a cable motor control valve, a manually operable cable control member, cable control linkage means for connecting said cable control member with said cable control valve and third means for varying the length of said cable control linkage means, said first, second and third means being effective to vary the length of each of said linkage means in response to a decrease in the length of cable hanging from the boom from a length greater than a predetermined length to a length less than a predetermined length.

14. An apparatus as set forth in claim 13 wherein said first means for varying the length of said extension linkage control means includes an extension hydraulic cylinder and said means for varying the length of said pivot linkage control means includes a pivot hydraulic cylinder and said means for varying the length of said cable linkage control means includes a cable hydraulic cylinder.

15. An apparatus as set forth in claim 14 further including valve means for porting hydraulic fluid to and from said extension hydraulic cylinder and to and from said pivot hydraulic cylinder and to and from said cable hydraulic cylinder, said valve means being movable from a first position in which said cylinders cause said linkage control means to have a first length and a second position in which said cylinders cause said linkages to have a second length, and solenoid means for moving said valve means from said first position to said second position in response to a decrease in the length of cable hanging from the boom from a length greater than a predetermined amount to a length less than a predetermined length.

16. A control system as set forth in claim 15 further including detector means for sending a signal in response to a decrease in the length of cable hanging from the boom from a length greater than a predetermined length to a length less than a predetermined length, said detector means including a tube through which said cable passes, said tube being raised against the influence of gravity when the length of cable hanging from the boom is less than the predetermined length.

17. The control system as set forth in claim 16, in which said tube through which the cable passes is suspended from switch means for activating said detector means, said switch means being held in the open position by the weight of said tube, whereby, when said tube is raised against the influence of gravity when the length of cable hanging from the boom is less than the predetermined length, said switch means is closed to activate the detector means.

* * * * *